US005232512A

United States Patent [19]

Swain

[11] Patent Number: 5,232,512

[45] Date of Patent: Aug. 3, 1993

[54] PRIMARY CLEANING OF PHOTORECEPTOR SUBSTRATES BY IMMERSION IN DRY ICE PARTICLES

[75] Inventor: Eugene A. Swain, Webster, N.Y.

[73] Assignee: Xerox Corporation, Stamford, Conn.

[21] Appl. No.: 858,807

[22] Filed: Mar. 27, 1992

[51] Int. Cl.[5] ..... B08B 7/04; B24B 1/00; B24C 7/00

[52] U.S. Cl. ..... 134/7; 134/8; 134/32; 134/33; 51/7; 51/322

[58] Field of Search ..... 134/6, 7, 32, 33, 8; 51/7, 17, 320, 322

[56] References Cited

U.S. PATENT DOCUMENTS

| | | | |
|---|---|---|---|
| 2,787,854 | 4/1957 | Simjian | 51/7 |
| 3,250,521 | 5/1966 | Sergent | 51/7 X |
| 3,250,643 | 5/1966 | Sergent | 51/7 X |
| 3,702,519 | 11/1972 | Rice et al. | 51/320 X |
| 4,662,425 | 5/1987 | Musschoot et al. | 134/7 X |
| 4,747,992 | 5/1988 | Sypula et al. | 264/130 |
| 4,795,496 | 1/1989 | Karaki et al. | 134/8 |
| 5,032,052 | 7/1991 | Swain | 414/222 |
| 5,038,707 | 8/1991 | Swain et al. | 118/58 |
| 5,123,206 | 6/1992 | Woodson | 51/320 |

FOREIGN PATENT DOCUMENTS

| | | | |
|---|---|---|---|
| 9118710 | 12/1991 | World Int. Prop. O. | 51/7 |

*Primary Examiner*—Theodore Morris
*Assistant Examiner*—Saeed T. Chaudhry
*Attorney, Agent, or Firm*—Oliff & Berridge

[57] ABSTRACT

A method and apparatus for cleaning photoreceptor substrates where at least one substrate is rotated in a bath of moving dry ice particles. The dry ice particles contact the outer surface of the substrate, melt locally upon contact and refreeze to capture particulate contaminants on the outer surface of the dry ice particles. An inert gas counter current to the flow of moving dry ice particles is supplied to enhance cleaning efficiency and assist in removing carbon dioxide, contaminants and small dry ice particles.

14 Claims, 2 Drawing Sheets

PRIMARY CLEANING OF PHOTORECEPTOR SUBSTRATES BY IMMERSION IN DRY ICE PARTICLES

BACKGROUND OF THE INVENTION

1. Field of the Invention

The invention relates to a method and apparatus for cleaning photoreceptor substrates. More particularly, the invention relates to an efficient cleaning method and apparatus that reduces the cost of the cleaning process, eliminates use of solvents or CFC's, is useful in cleaning photoreceptor substrates (metallic or plastic rigid cylinders, metallic or plastic flexible seamless belts, and the like) and, for that matter, any smooth surface object subject to strict cleanliness standards during manufacture, thereby reducing the unit manufacturing cost by virtue of this simplified cleaning process.

2. Description of Related Art

A photoreceptor is a cylinder or belt-like device used in a xerographic apparatus. The photoreceptor substrate is coated with one or more layers of a photoconductive material, i.e., a material whose electrical conductivity changes upon illumination. In xerographic use, an electrical potential is applied across the photoconductive layer and then exposed to light from an image. The electrical potential of the photoconductive layer decays at the portions irradiated by the light from the image, leaving a distribution of electrostatic charge corresponding to the dark areas of the projecting image. The electrostatic latent image is made visible by development with a suitable powder. Better control of the coating quality yields better imaging performance.

The coating of a substrate is generally accomplished through an automated four step process, whereby the substrate to be coated is first loaded on a support arm structure (Step 1) which then moves the substrate to successive processing stations. The substrate is first moved to the cleaning station (Step 2) which includes a cleaning chamber for receiving the support arm bearing the substrate and having decontaminating means for removing contaminants from the substrate; and then on to a coating station (Step 3) which includes a coating chamber for receiving the support arm bearing the substrate and having an applicator for applying a coating formulation onto the substrate. Finally, the substrate is moved to a curing station (Step 4) which includes a curing chamber for receiving the support arm bearing the coated substrate and has curing means for curing the coating on the substrate. An apparatus and method for processing as described above, is detailed generally in U.S. Pat. Nos. 5,032,052 (Swain), 5,038,707 (Swain et al.) and 4,747,992 (Sypula et al.) which are referenced here for purposes of describing a substrate coating and manufacturing process. In addition, as well known in the art, other suitable methods for coating photoconductive layers can be utilized, such as dip coating, vacuum deposition and the like.

Primary cleaning, an initial step in the photoreceptor coating process described above, is the key to obtaining the aforementioned high yield with reduced manufacturing costs. Processes currently in use employ some combination of mechanical brush, liquid detergents, freon or ozone sprays with simultaneous exposure to ultraviolet light, ultrasonic and/or vapor cleaning. In whatever combination, it is a costly and complex operation which inevitably will require altering since freon/CFC's will eventually be banned. The method and apparatus proposed herein will replace part or all of the existing photoreceptor cleaning methods and perhaps most importantly, will be available for future cleaning applications (i.e., seamless flexible belt substrates, plastic rigid substrates and any other smooth surface critical parts, such as semiconductor substrates) which require extreme cleanliness during manufacture.

SUMMARY OF THE INVENTION

It is thus an object of the invention to obviate the foregoing drawbacks of the prior art by providing a more efficient process and apparatus for cleaning photoreceptor substrates during manufacture.

Another object of the invention is to provide a method or apparatus which permits cleaning of photoreceptor substrates without the use of harsh solvents or environmental contaminants such as freon and ozone.

It is still another object of the invention to provide an apparatus or method which routinely meets or exceeds extremely strict manufacturing standards for cleanliness.

Another object of the invention is to provide a method or apparatus for cleaning photoreceptor substrates which is automatic and highly adaptable to cleaning different substrates of varying diameters.

These and other objects and advantages are obtained by the inventive method and apparatus for cleaning photoreceptor substrates by immersion in dry ice particles. The method and apparatus includes a cleaning chamber with sealing means for receiving a support arm bearing at least one photoreceptor substrate to be cleaned and having decontaminating means for removing contaminants from the substrate. The decontaminating means includes a dry ice particle bath, the dry ice particles being of a particular diameter, which is fed into the cleaning chamber at one end while spent and contaminant laden dry ice particles are removed at the other end of the cleaning chamber. The substrate to be cleaned is introduced by the support arm into the cleaning chamber containing the dry ice particle bath and rotated at a predetermined speed which causes the dry ice particles to rub against the substrate surface in a scrubbing action, thereby causing localized melting and refreezing, and allowing the dry ice particles to capture contaminant particulates. The cleaning chamber is also equipped with a perforated other end connected to a distribution plenum through which a filtered inert gas (the inert gas must be dry and highly pure to prevent water vapor condensation within the chamber) is supplied at a controlled rate. The inert gas, which permeates and contraflows through the dry ice particle bath as the substrate rotates, is collected at an exhaust port located near the one end of the cleaning chamber. In this way, substantial purging of contaminant particulates and carbon dioxide, released by the dry ice via sublimation, takes place. The cleaning chamber may also include a directing baffle which is disposed within and attached to an inner wall of the cleaning chamber to partially restrict the flow of dry ice particles. This flow restriction improves the cleaning process by forcing the dry ice particles against the substrate surface while it is rotated thereby increasing contact and pressure of the dry ice particles against the substrate surface. In a further improvement to the cleaning chamber described above, a squeezing means, disposed within the cleaning chamber and actuated via known means, compresses the dry ice particles against the substrate surface at the beginning of the cleaning cycle, thereby increasing contact and melting pressure of the dry ice particles against the substrate surface and enhancing the removal of contaminants from the substrate. The squeezing means is contained within a flexible sleeve or boot that allows movement of the squeezing means within the cleaning chamber, but does not allow the dry ice particles access to the region behind the squeezing means. At a predetermined time, the squeezing means is retracted automatically via the actuator and the cleaning process continues uninterrupted as described above until completion.

Other objects, advantages and salient features of the invention will become apparent from the following detailed description, which taken in conjunction with the annexed drawings, discloses preferred embodiments of the invention.

BRIEF DESCRIPTION OF THE DRAWINGS

Referring now to the drawings which form a part of this original disclosure.

DETAILED DESCRIPTION OF THE PREFERRED EMBODIMENT

The primary photoreceptor cleaning method and apparatus will be described in relation to fabrication of cylindrical and belt-like photoreceptor substrates, and particularly rigid cylindrical and flexible belt photoreceptor substrates for photocopiers. The invention, however, is applicable to other smooth surface substrates requiring extreme cleanliness during manufacture.

Figure 1:
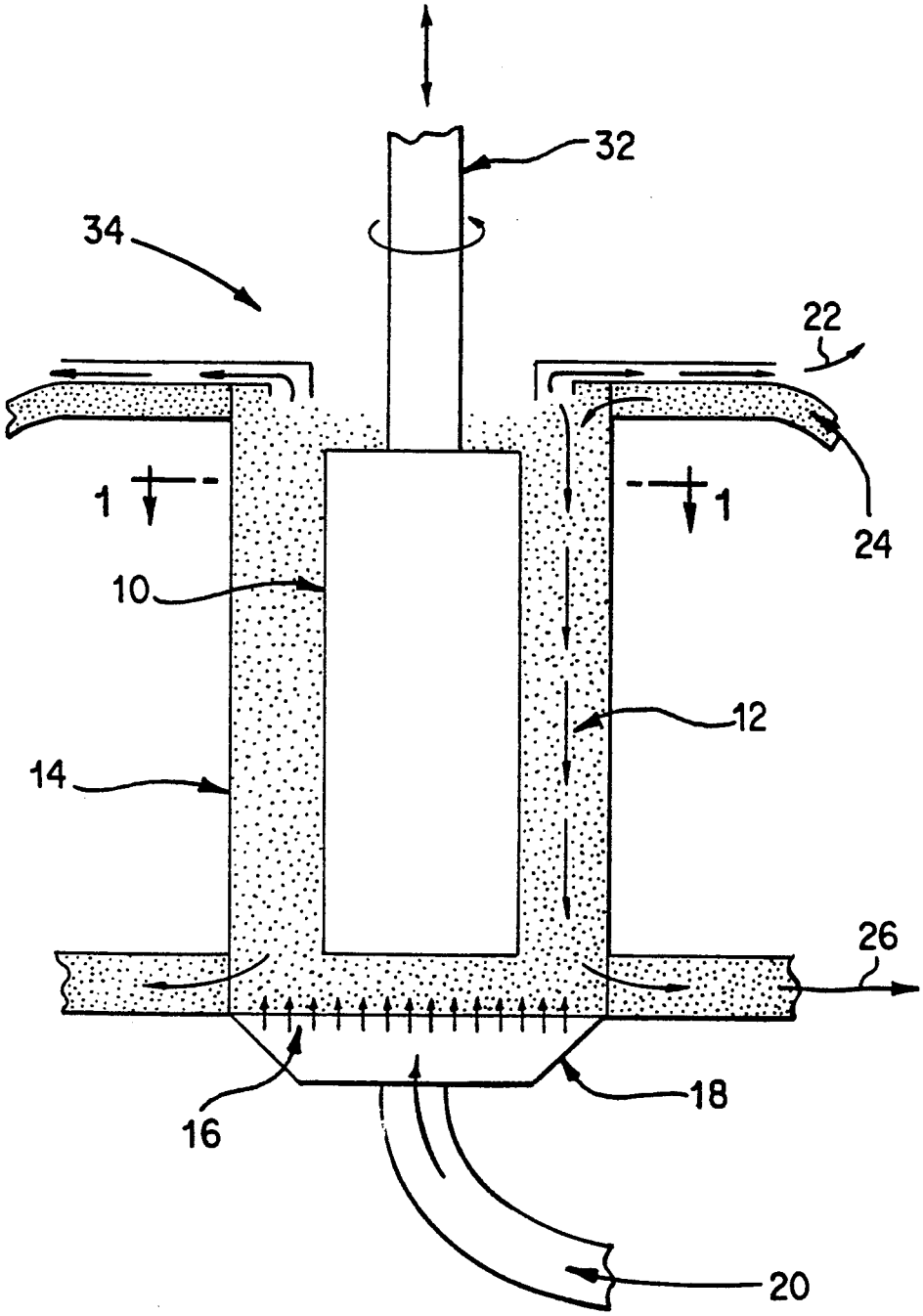
FIG. 1 is a schematic plan view of the cleaning chamber with a substrate shown immersed in the dry ice bath.

As illustrated in FIG. 1, the overall apparatus and process for primary cleaning of photoreceptor substrates includes a cleaning chamber 14 with sealing means (not shown) for receiving at least one support arm 32 bearing at least one substrate 10, the sealing means sealing the open end of cleaning chamber 14 through which the at least one support arm 32 is inserted. The cleaning chamber 14 has decontaminating means 34 for removing contaminant particles from the substrate surface 10. The decontaminating means 34 includes a dry ice particle bath 12, where dry ice particles of a particular diameter, preferably in the range of ¼ to 1/32 inch, are fed into the cleaning chamber 14 through a dry ice supply port 24 at a first end region of said cleaning chamber 14, while spent and contaminant laden dry ice particles are removed at a dry ice and contaminant exhaust port 26 at a second end region of the cleaning chamber 14.

The cleaning chamber 14, and necessarily the decontaminating means 34, is additionally equipped at a second end region with a perforated chamber portion 16 connected to a distribution plenum 18 through which filtered inert gas, preferably dry nitrogen, is supplied at a controlled rate through an inert gas supply port 20. The inert gas permeates and contraflows through the dry ice particles 12 and is collected through an exhaust port 22 located near the first end region of the cleaning chamber 14. This element of the decontaminating means 34, prevents water vapor condensation within the chamber 14 of carbon dioxide and contaminant particulates released by the dry ice via sublimation.

The substrate 10 to be cleaned is inserted into the cleaning chamber 14 by the support arm 32 and rotated by the support arm 32 at a predetermined speed. The substrate preferably rotates during the cleaning process in the rage of 30–200 rpm. Rotating the substrate 10 in the dry ice particle bath 12 causes the dry ice particles 12 to rub against the substrate surface 10 in a scrubbing action, which causes localized melting and refreezing, thereby capturing contaminant particulates on the dry ice surface.

Those particulates, not released and purged by the inert gas flow, are carried away, together with spent dry ice particles, through a dry ice and contaminant collection port 26 located at the second end region of the cleaning chamber 14. Throughout the process, dry ice particles 12 are constantly being replenished through the dry ice supply port 24. Similarly, the inert gas flow continues uninterrupted with the gas entering through the perforated chamber 16 of the cleaning chamber 14 and exiting through the inert gas exhaust port 22. The action of the inert gas moving against the dry ice causes sufficient mixing and counter current to ensure proper scrubbing action against the substrate 10 to be cleaned.

After completion of the cleaning cycle, i.e., at a predetermined time, the chamber sealing means (not shown) opens and the support arm 32 retracts the substrate 10 from the cleaning chamber 14. The support arm 32 the, if part of the photoreceptor manufacturing system described above, moves the substrate to the next station in the manufacturing process. After removal, the substrate 10 is extremely cold and, therefore, must be protected from water vapor condensation to ensure that the cleaned substrate 10 is not thusly recontaminated. Several methods exist of preventing water vapor condensation, for instance, providing non-contact heaters through which the substrate passes or, preferably, the substrate 10 is maintained in a dry, inert atmosphere throughout the coating process. In any event, the substrate is now clean and ready for further processing.

Figure 2:
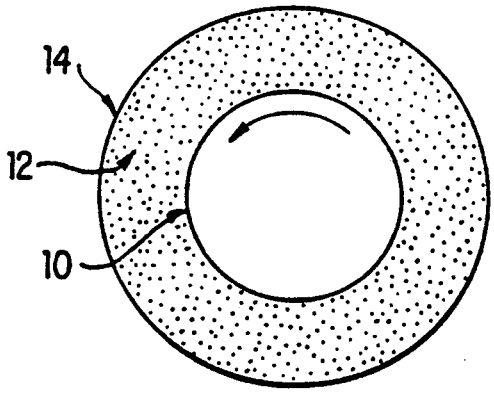
FIG. 2 is a schematic top cross-sectional view through the cleaning chamber in FIG. 1 along line 1—1.

FIG. 2 shows the substrate 10 being rotated in the cleaning chamber 14 and the dry ice bath 12 with the inert gas contra-flow 20 exhibiting its scrubbing action against the substrate surface. It will be noted, that this is a top cross-sectional view of the cleaning chamber 14 along line 1—1 of FIG. 1.

Figure 3:
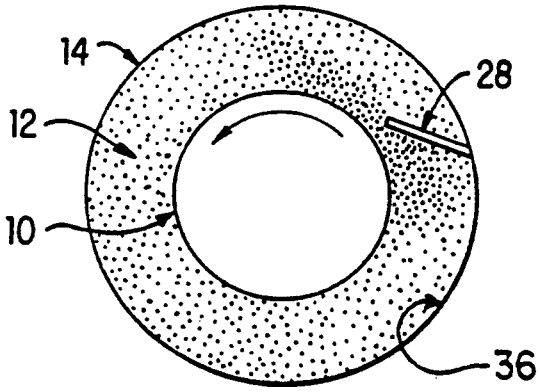
FIG. 3 is a schematic top cross-sectional view of the cleaning chamber in FIG. 1 along line 1—1 showing the directing baffle.

FIG. 3 shows another embodiment of the cleaning chamber 14. The only difference from the embodiment shown in FIGS. 1 and 2 is that at least one directing baffle 28 is attached to an inner wall 36 of the cleaning chamber 14 to at least partially restrict and therefore, increase the flow rate of dry ice particles 12. This forces the dry ice particles 12 against the substrate surface 10 by a wedging action while the substrate is rotated thereby increasing contact and pressure of the dry ice particles 12 as they scrub against the substrate surface 10. In this way, enhanced cleaning is obtained for situations requiring heightened cleanliness or a substrate with particularly difficult to remove contaminant particulates.

Figure 4:
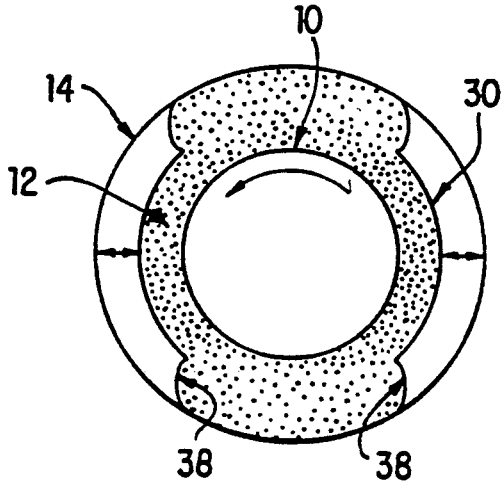
FIG. 4 is a schematic top cross-sectional view through the cleaning chamber in FIG. 1 along line 1—1 showing the squeezing means.

FIG. 4 shows another embodiment of the cleaning chamber according to the invention. The only difference from the embodiment shown in FIGS. 1 and 2 is that a squeezing means 30 disposed within the chamber 14 and actuated by known means, such as hydraulic, pneumatic or worm screw actuators, (not shown) has been added. The squeezing means 30 compresses the dry ice particles 12 against the substrate surface 10 for a predetermined time near the beginning cycle of the cleaning process, while the substrate 10 continues to be rotated. Again increased contact and melting pressure of the dry ice particles 12 against the substrate surface 10 results, thereby enhancing the removal of contaminant particulates from the substrate 10. The squeezing means 30 may be contained within a flexible sleeve or boot 38 that allows movement of the squeezing means 30 within the cleaning chamber 14, but does not allow the dry ice particles 12 access to the region behind the squeezing means 30. After completion of the compressing step, at a predetermined time, the squeezing means 30 is automatically retracted via the actuator and the cleaning process continues uninterrupted as described above until completion. As above, this process is extremely effective when heightened cleanliness standards must be maintained or a particularly difficult and contaminated substrate is to be cleaned. It may additionally prove effective when cleaning substrates of a significantly reduced diameter.

Although the invention has been shown and described with respect to preferred embodiments thereof, it should be understood by those skilled in the art that various changes in the form and detail thereof may be made therein without departing from the spirit and scope of the invention as defined in the appended claims.

What is claimed:

1. A process for cleaning at least one photoreceptor substrate, comprising the steps of:

feeding dry ice particles through a dry ice supply port into a first end region of a cleaning chamber, the cleaning chamber having a second end region with a perforated chamber portion and connected to a distribution plenum;

supplying a substantially anhydrous inert gas to the plenum at a controlled rate which permeates and contraflows through the dry ice particles and is collected by an exhaust port located at the first end region of said cleaning chamber;

inserting a substrate to be cleaned into the cleaning chamber by means of a support arm;

rotating the substrate to be cleaned while in the cleaning chamber by means of said support arm, wherein the dry ice particles scrub against the substrate surface causing localized melting and refreezing, thereby capturing contaminant particulates on the dry ice surface and carrying said particulates away from the substrate;

increasing contact and pressure of the dry ice particles against said substrate surface;

releasing said contaminant particulates by sublimation and substantially purging carbon dioxide and said particulates via the inert gas flow;

removing said particulates not released and purged by the inert gas flow together with spent dry ice particles at a dry ice and contaminant exhaust port located at the second end region of said cleaning chamber, while said dry ice particles are being replenished through the dry ice supply port at a first end region of said cleaning chamber; and retracting said substrate to be cleaned from the cleaning chamber by means of said support arm.

2. The process according to claim 1, wherein the step of increasing contact and pressure of the dry ice particles against said substrate surface comprises at least one directing baffle disposed within and attached to an inner wall of said cleaning chamber which is provided to at least partially restrict the flow of dry ice particles, thereby forcing said dry ice particles against the substrate surface when said substrate is rotated.

3. The process according to claim 1, wherein the step of increasing contact and pressure of the dry ice particles against said substrate surface comprises a further step of compressing the dry ice particles against said substrate surface, by means of a squeezing means disposed within said cleaning chamber for a predetermined time near a beginning cycle of the cleaning process, while said substrate is rotated, to increase contact and melting pressure of the dry ice particles against said substrate surface, whereupon, after completion of the compressing step, the squeezing means is automatically retracted and the cleaning process continues uninterrupted.

4. The process according to claim 1, wherein a dry ice particle diameter is in the range of ¼ to 1/32 inch.

5. The process according to claim 1, wherein said inert gas is highly pure dry nitrogen to prevent water vapor condensation within the cleaning chamber.

6. The process according to claim 1, wherein said support arm rotating speed is in the range of 30–200 rpm.

7. The process according to claim 1, wherein said cleaning process is used for cleaning at least one of a metallic cylinder substrate, seamless flexible belt substrate, plastic rigid substrate, semi-conductor substrate and such similar smooth surface objects requiring extreme cleanliness in manufacturing.

8. An apparatus for cleaning at least one cylindrical photoreceptor substrate, comprising:

a cleaning chamber for receiving at least one support arm bearing a substrate and said cleaning chamber having a pressing means and a decontaminating means for removing contaminant particulates from the substrate, said decontaminating means comprising a dry ice particle bath, said dry ice particles being fed into the cleaning chamber via a dry ice supply port at a first end region of said cleaning chamber while spent and contaminant laden dry ice particles are removed via a dry ice and contaminant exhaust port at a second end region of said cleaning chamber;

movement means for inserting and retracting said substrate to be cleaned into and out of the cleaning chamber containing the dry ice particle bath and rotating said substrate to be cleaned at a predetermined speed while in the dry ice particle bath, causing the dry ice particles to rub against the substrate surface in a scrubbing action which causes localized melting and refreezing, thereby capturing contaminant particulates on the dry ice surface;

said cleaning chamber further comprising a perforated chamber portion located at a second end region of said cleaning chamber which is connected to a distribution plenum through which a substantially anhydrous inert gas is supplied at a controlled rate, said inert gas permeating and contra-flowing through the dry ice particles as the substrate rotates and is collected through an exhaust port located at the first end region of said cleaning chamber, thereby substantially purging carbon dioxide and said contaminant particulates released by the dry ice via sublimation and substantially preventing water vapor condensation within said cleaning chamber.

9. The apparatus according to claim 8, wherein a particle diameter of said dry ice is in the range of ¼ to 1/32 inch.

10. The apparatus according to claim 8, wherein said inert gas is highly pure dry nitrogen.

11. The apparatus according to claim 8, wherein said rotating speed is in the range of 30–200 rpm.

12. The apparatus according to claim 8, wherein the substrate to be cleaned is at least one of a metallic cylinder substrate, seamless flexible belt substrate, plastic rigid substrate, semi-conductor substrate, and such similar smooth surface objects requiring extreme cleanliness in manufacturing.

13. The apparatus according to claim 8, wherein said cleaning chamber pressing means further comprises at least one directing baffle disposed within and attached to an inner wall of said cleaning chamber to at least partially restrict the flow of dry ice particles, thereby forcing said dry ice particles against the substrate surface when said substrate is rotated, increasing contact and pressure of the dry ice particles against said substrate surface.

14. The apparatus according to claim 8, wherein said cleaning chamber pressing means further comprises a squeezing means disposed within said cleaning chamber with an actuating means for compressing the dry ice particles against said substrate surface, thereby increasing contact and melting pressure of the dry ice particles against said substrate surface, said squeezing means being automatically retracted via the actuating means after completing the step, while the cleaning process continues uninterrupted.

* * * * *